US008549851B2

(12) United States Patent
Grussmann et al.

(10) Patent No.: US 8,549,851 B2
(45) Date of Patent: Oct. 8, 2013

(54) EXHAUST MANIFOLD WITH BAFFLE PLATE

(75) Inventors: Elmar Grussmann, Altenbeken-Buke (DE); Fabian Fricke, Paderborn (DE); Ralph Naubert, Neumarkt (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 341 days.

(21) Appl. No.: 12/967,470

(22) Filed: Dec. 14, 2010

(65) Prior Publication Data

US 2011/0308238 A1 Dec. 22, 2011

(30) Foreign Application Priority Data

Dec. 14, 2009 (DE) ..... 10 2009 058 047

(51) Int. Cl.
*F01N 1/00* (2006.01)

(52) U.S. Cl.
USPC ..... 60/323; 60/321; 60/322

(58) Field of Classification Search
USPC ..... 60/274–324
See application file for complete search history.

(56) References Cited

U.S. PATENT DOCUMENTS

| | | | | |
|---|---|---|---|---|
| 4,537,027 | A * | 8/1985 | Harwood et al. | 60/323 |
| 4,777,708 | A * | 10/1988 | Harwood et al. | 29/890.08 |
| 4,850,189 | A * | 7/1989 | Arthur et al. | 60/323 |
| 5,784,881 | A | 7/1998 | Otsuka et al. | |
| 6,474,697 | B2 * | 11/2002 | Nording et al. | 285/179 |
| 6,789,386 | B1 * | 9/2004 | Haerle | 60/323 |
| 7,198,459 | B2 | 4/2007 | Grussmann et al. | |
| 2008/0134672 | A1 * | 6/2008 | Willeke et al. | 60/323 |
| 2009/0282820 | A1 * | 11/2009 | Hill et al. | 60/323 |

FOREIGN PATENT DOCUMENTS

| | | | |
|---|---|---|---|
| DE | 103 41 868 | B4 | 4/2005 |
| DE | 103 59 073 | A1 | 7/2005 |
| DE | 10359073 | A1 * | 7/2005 |
| EP | 0 717 179 | | 6/1996 |
| EP | 765994 | A1 * | 4/1997 |
| EP | 1 172 534 | | 1/2002 |
| JP | 63-158527 | | 10/1988 |
| JP | 9-296725 | | 11/1997 |
| JP | 09-317462 | | 12/1997 |
| JP | 2000248927 | | 9/2000 |
| WO | WO 2009/091540 | | 7/2009 |

* cited by examiner

*Primary Examiner* — Thomas Denion
*Assistant Examiner* — Jesse Bogue
(74) *Attorney, Agent, or Firm* — Henry M. Feiereisen LLC

(57) ABSTRACT

An exhaust manifold includes a housing formed of a thin-walled sheet metal part which is shaped in the form of a shell construction and has an upper housing shell and a lower housing shell to define an interior space. Received in the housing in an area proximate to a cylinder head of an internal combustion engine is a baffle plate which separates the interior space of the housing from a motor flange to secure the exhaust manifold to the cylinder head.

13 Claims, 2 Drawing Sheets

EXHAUST MANIFOLD WITH BAFFLE PLATE

CROSS-REFERENCES TO RELATED APPLICATIONS

This application claims the priority of German Patent Application, Serial No. 10 2009 058 047.6-13, filed Dec. 14, 2009, pursuant to 35 U.S.C. 119(a)-(d), the content of which is incorporated herein by reference in its entirety as if fully set forth herein.

BACKGROUND OF THE INVENTION

The present invention relates to an exhaust manifold, and more particularly to an exhaust manifold for attachment by a motor flange to a cylinder head of an internal combustion engine with at least two in-line cylinders.

The following discussion of related art is provided to assist the reader in understanding the advantages of the invention, and is not to be construed as an admission that this related art is prior art to this invention.

Exhausts from cylinders of a multi-cylinder internal combustion engines and carried away by an exhaust manifold are united in exhaust collectors. Exhaust manifolds can be made of cast steel or assembled from single steel sheets or pipe fittings welded to one another. Cast-steel manifolds can be produced in a fairly cost-effective manner even when their geometry is complex. Their weight however is normally higher than the weight of welded steel-sheet constructions. Also, cast-steel manifolds exhibit a greater thermal inertia than welded exhaust manifolds. On the other hand, welded exhaust manifolds with complex geometry are difficult to make and thus expensive. A benefit of welded exhaust manifolds is their low weight and their small heat capacity.

Also known are airgap-insulated exhaust manifolds having exhaust carrying ducts which are surrounded by a supporting outer shell at a distance to define an airgap. The outer shell is normally welded gastight with mounting flanges. Due to the complex construction, airgap-insulated exhaust manifolds are expensive.

In order to improve the efficiency of internal combustion engines, the engines are oftentimes charged by a compressor, typically a turbocharger. By making the turbocharger more efficient, it is possible to also increase the efficiency of the internal combustion engine. Charging of the internal combustion engine should occur quickly. This is possible only when the turbocharger quickly starts up so as to eliminate the undesired turbo lag. This requires however certain flow rates in order to prevent the gas impulse of combustion gases emitted from the motor from weakening in the exhaust manifold. Therefore, duct cross sections should be selected that they are not too big in cross section in order for the impulse to act substantially directly on the blades of the turbocharger or also to be able to realize its desired effect in a pressure-wave supercharger. Thus, when striving to provide a greatly contoured cross sectional geometry of the exhaust conducting ducts or exhaust manifold, the exhaust manifold becomes normally fairly complex. This poses a problem when manufacturing exhaust manifolds which have not been made by an original forming process because the sheet metal parts become more and more complex requiring complex configuration of the weld seam that further poses manufacturing problems so that the overall product quality and the product price are adversely affected.

It would therefore be desirable and advantageous to provide an improved exhaust manifold which obviates prior art shortcomings and which has little heat capacity and is easy to manufacture while resulting in a reliable and efficient operation of an internal combustion engine.

SUMMARY OF THE INVENTION

According to one aspect of the present invention, an exhaust manifold includes a housing formed of a thin-walled sheet metal part shaped in the form of a shell construction and having an upper housing shell and a lower housing shell to define an interior space, and a baffle plate received in the housing in an area proximate to a cylinder head of an internal combustion engine having at least two in-line cylinders, with the baffle plate separating the interior space of the housing from a motor flange to secure the exhaust manifold to the cylinder head.

By separating the motor flange from the interior space of the exhaust manifold, heat introduction into the solid motor flange is reduced. The motor flange is normally configured as cast-steel product to provide the exhaust manifold with a high thermal inertia. The mass of the motor flange cannot easily be reduced because of its support function for the exhaust system and is subject to high thermal stress. As a result, the present invention pursues an approach by which the flange is separated at least in some areas from the interior space of the exhaust manifold. This approach does not involve a connection of the sheet metal shells of the exhaust manifold with the motor flange only in some areas such as only in the area of exhaust ports but rather involves the presence of a baffle plate inside the exhaust manifold to assume a shielding function. This has the advantage that the exhaust manifold, i.e. upper and lower housing shells of the exhaust manifold, can be welded completely with the motor flange, using significantly simpler configuration of the weld seam. The upper and lower housing shells of the exhaust manifold become much less complex. The simplified geometry permits the use of simpler tools and thus leads to a more cost-efficient manufacture of the sheet metal parts. In particular, welding the upper and lower housing shells with the motor flange is rendered easier because the exhaust manifold can be configured as a hood without consideration as to the implementation of the shielding against the motor flange because the baffle plate assumes this function. The configuration of the baffle plate influences the flow path of exhaust within the exhaust manifold. This has a positive effect on the start-up behavior of a downstream turbocharger so that the overall efficiency of the internal combustion engine increases. The construction from thin-walled sheet metal parts results in small heat capacity and thus to low heat dissipation so that a downstream catalytic converter is able to more quickly reach the necessary operating temperature, which means that emission limits can be better met.

According to another advantageous feature of the present invention, the baffle plate may be designed in the form of a single-piece baffle plate.

According to another advantageous feature of the present invention, the baffle plate can be sized to cover surfaces of the motor flange that face the interior space. In this way, heat can be introduced from heat energy contained in the exhaust into to the motor flange only to a limited degree. Of course, several individual baffle plates may be arranged between the individual exhaust ports of the motor flange respectively and best suited individually to the flow conditions present in the area of these exhaust ports.

According to another advantageous feature of the present invention, the baffle plate can have openings in an area of exhaust ports of the motor flange. Exhaust gas thus flows through the exhaust ducts of the cylinder head and the exhaust ports of the motor flange directly into the exhaust manifold. The exhaust ports in the baffle plate make it clear that the baffle plate extends around the ports. When the exhaust manifold has four exhaust ports for example, the baffle plate may also have four openings accordingly so that only one baffle port needs to be produced which then is aligned and secured to the housing shells of the exhaust manifold and the motor flange. Of course, it is certainly conceivable within the scope of the invention to provide several individual baffle plates with respective openings for the exhaust ports of the motor flange. Several of these baffle plates may be joined to an assembly before installation in the exhaust manifold. Still the provision of a single suitably configured baffle plate is currently preferred because the number of components for producing the exhaust manifold is kept to a minimum.

According to another advantageous feature of the present invention, the baffle plate may be formed with collars provided in an area of the openings and extending into the exhaust ports. As a result, the exhaust flow is separated from the motor flange already in the exhaust port. The outgoing exhaust is therefore thermally insulated from the motor flange when exiting the exhaust duct of the cylinder head. Thus, thermal inertia decreases in the entire exhaust manifold, positively affecting situations of increased emission standards as far as internal combustion engines are concerned. In particular during cold-start performance, the response of peripheral exhaust devices, like e.g. a NOx catalytic converter or a Diesel particle filter, is shortened as a result of a rapid heating.

According to another advantageous feature of the present invention, a sliding fit may be provided between the collars and the exhaust ports of the motor flange. The baffle plate is made from a thin-walled sheet metal part, whereas the motor flange is made of thick-walled cast material. The baffle plate is directly exposed to the hot exhaust flow whereas the motor flange is exposed to ambient temperature. In particular during cold-start performance or also during full-load operation, the different thermal expansion of material and constructions is noticeable. Possible warping as a result of different thermal expansions can be compensated by a sliding fit so that the baffle plate has a longer service life.

According to another advantageous feature of the present invention, the baffle plate has at least one area which is spaced at a distance from the motor flange in a region between neighboring openings. This has in this area the advantage of the presence of a hollow space which thermally insulates the motor flange from the baffle plate. The hollow space may be filled with exhaust which in view of the gas inertia has a smaller temperature and possibly a smaller pressure ratio than the exhaust inside the exhaust manifold. Even when the hollow space is filled with exhaust, this does not mean that the motor flange is now no longer separate from the interior space of the baffle plate. The term "separate" is to be understood within the scope of the present invention as not necessarily requiring a hermetic, in particular gastight shielding which can be realized only by an especially careful connection of the baffle plate with the upper and lower housing shells. Rather, shielding means that a major part of the exhaust gas does not contact the motor flange as a result of the flow rate and flow direction, whereby a pressure compensation between the interior space of the exhaust manifold and the separate hollow spaces which may also be located in the exhaust manifold, causes a slight gas exchange which however does not exceed the referred-to pressure compensation. Thus, the benefits realized by the present invention are also attained with a baffle plate that is not connected in a gastight manner with the upper and lower housing shells, even though substantial gas tightness is desired.

The presence of hollow spaces is also beneficial because it leads to a volumetric decrease of the interior space of the exhaust manifold. A small volume of the interior space of the exhaust manifold is of advantage in particular in connection with responsiveness of the turbine wheel of a turbocharger. An exiting gas impulse from a cylinder in the form of an exhaust cycle is thus substantially directly conducted to the turbine blades. This counteracts a decrease of the flow rate in view of an increasing volume of the exhaust manifold.

According to another advantageous feature of the present invention, regions between the openings may have an arched configuration. The volume of the interior space of the exhaust manifold is reduced in size in a desired manner by the arched configuration with respect to exhaust routing. When referring to an arched geometry, a geometric shape is to be understood in which a greatest distance to the motor flange lies in mid-section between the two exhaust ports, with the distance to the exhaust ports decreasing so as to establish a contact to the exhaust ports at the end. Examples of an arched-shaped configuration may include a triangular, trapezoidal, or other shape. For fluidic reasons, the presence of smooth transitions is preferred so that the arch has actually a circular shape or an elliptic section or any other suitable configuration composed of curved sections.

Depending on the application at hand, the shape should be selected to best suit the internal combustion engine. This may also involve for example consideration of the exhaust back-pressure in the exhaust system. A further influencing factor in connection with shape selection of the distance of the baffle plate to the motor flange between the exhaust ports is for example the arrangement of a further flange for attachment of an exhaust pipe or of two flanges or an exhaust gas recirculation. Thus, there is no requirement to provide identical arched regions between all neighboring exhaust ports. The arched regions may substantially vary in design to best suit the situation at hand. Important is only their function to shield the motor flange and to distance the exhaust and heat introduction through the presence of a hollow space from the motor flange and to suit the flow cross sections accordingly.

According to another advantageous feature of the present invention, the baffle plate may have a wrap-around contact zone which bears against the upper housing shell and the lower housing shell. As a result, the motor flange is separated by the interior space of the exhaust manifold formed by the upper and lower shells and the baffle plate. The contact zone may hereby be gastight or not gastight.

According to another advantageous feature of the present invention, the contact zone may be configured to extend in parallel relation to complementing surfaces of the upper and lower housing shells. Suitably, the contact zone can be configured substantially as wrap-around flange constructed to point to the motor flange or away from the motor flange. The wrap-around flange increases stiffness of the baffle plate against high pressure encountered inside the exhaust manifold. Furthermore, the flanged configuration provides the whole exhaust manifold a higher stiffness against pressure and vibrations, thereby positively affecting the service life of the exhaust manifold.

According to another advantageous feature of the present invention, a sealing compound may be applied to the wrap-around flange. In this way, the baffle plate is sealed in a gastight manner in the contact zone all-around.

According to another advantageous feature of the present invention, the baffle plate can be securely fixed to the upper and lower housing shells in at least one area of the contact zone. Currently preferred is a fixed securement of the baffle plate to the upper and lower housing shells by a material joint, for example thermal joining, to effect a long service life. Thermal joining has the benefit that the exhaust manifold can be manufactured in a cost-efficient manner while maintaining integrity. Service life is an important factor because different temperature-dependent expansions of individual components are involved. Thermal expansions result in stress, especially in the area of the weld seams. As a result of the vibration stress encountered in the exhaust system, it must be ensured that no components become loose which could lead to an functional impairment as well as to annoying rattling noises.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
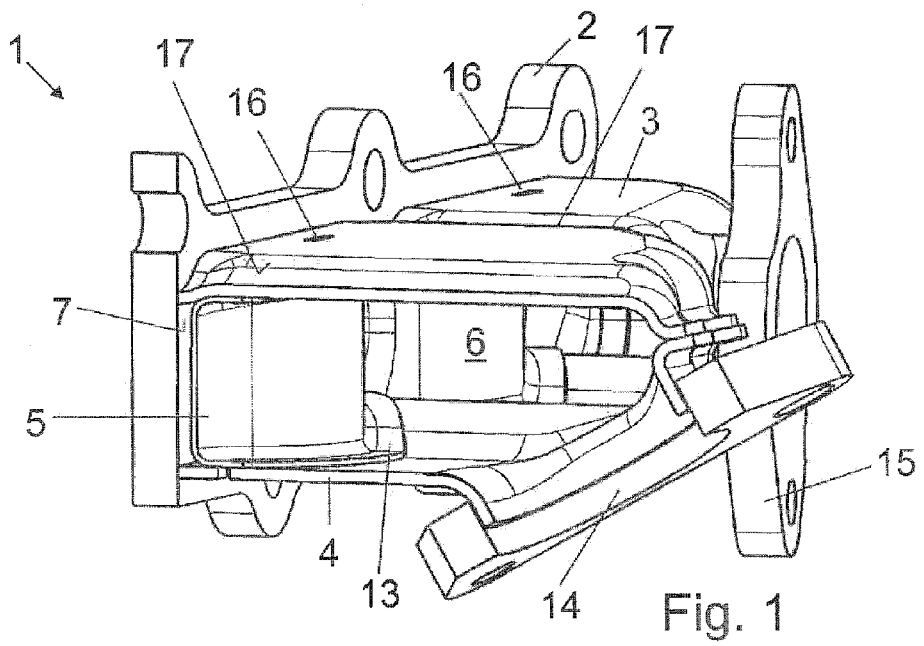
FIG. 1 is a perspective sectional view of an exhaust manifold according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a perspective sectional view of an exhaust manifold according to the present invention, generally designated by reference numeral 1. The exhaust manifold 1 includes a motor flange 2 for attachment of the exhaust manifold 1 to a cylinder head of an internal combustion engine having at least two in-line cylinders. The exhaust manifold 1 includes a housing formed of a thin-walled sheet metal part that is shaped by way of a shell construction to define an upper housing shell 3 and a lower housing shell 4 which demarcate an interior space 6. A baffle plate 5 is received in an interior space 6 of the thus formed exhaust manifold 1 and separates the interior space 6 of the exhaust manifold 1 from surfaces 7 of the motor flange 2.

Figure 2:
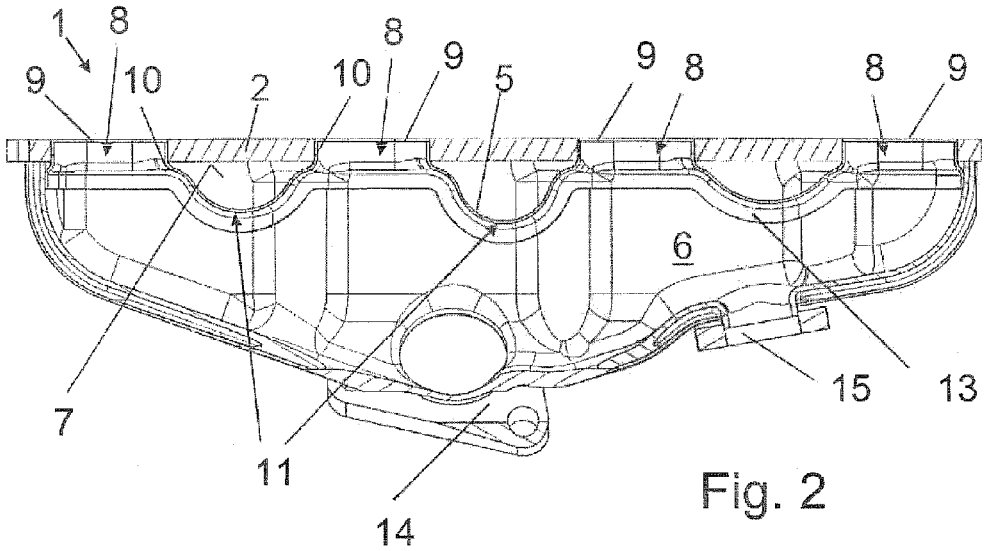
FIG. 2 is a longitudinal section by way of a top view of the exhaust manifold.

FIG. 2 shows a longitudinal section by way of a top view of the exhaust manifold 1. The baffle plate 5 has openings 8 which extend in exhaust ports 9 of the motor flange 2. For that purpose, the openings 8 of the baffle plate 5 have collars 10.

The baffle plate 5 separates in regions 11 between the openings 8 the surfaces 7 of the motor flange 2 from the interior space 6 of the exhaust manifold 1. The regions 11 between the openings 8 have a substantially arched configuration. In the non-limiting example of FIG. 2, the arched region in midsection of the drawing plane has a greater extension into the interior space 6 than the arched regions near the margins. The respectively outer arched region may thus be configured flatter because the housing of the exhaust manifold 1 has a smaller cross section in its end regions than in its middle region where an exhaust flange 14 is provided to which the collected exhaust gases are fed.

As further shown in FIGS. 1 and 2, a flange 15 is provided for exhaust gas recirculation. The exhaust flange 14 and the flange 15 for the exhaust gas recirculation extend in the non-limiting example shown here at an angle relative to one another, with the flange 15 being arranged in a transition zone of the upper housing shell 3 to the lower housing shell 4. The exhaust flange 14 is hereby provided in the area of the lower housing shell 4.

As further shown in FIG. 1, two apertures 16 are provided in the area of the upper housing shell 3. The apertures 16 are provided to secure the baffle plate 5 by welding the baffle plate 5 in the area of the apertures. Welding is implemented with flanged rims 13 of the baffle plate 5. The flanges rims 13 are part of a contact zone 12 which extends in parallel relation to corresponding surfaces of the upper and lower housing shells 3, 4. In FIG. 1, the upper and lower housing shells 3, 4 have confronting outer sides which are not planar but are formed with embossments 17 which are provided to enable screwed connection of the motor flange 2 to an internal combustion engine, not shown in greater detail. When looking into the interior space 6 of the exhaust manifold 1, it can be seen that the flanged rim 13 has a profile conforming to the embossments 17 and to the remaining inner contour of the upper and lower housing shells 3, 4 to realize a greatest possible gas tightness. The apertures 16 are located between the embossments 17. These welding spots form effectively the fixed bearing of the baffle plate 5 which projects into the individual exhaust ports 9 of the motor flange through intervention of a sliding fit.

Figure 3:
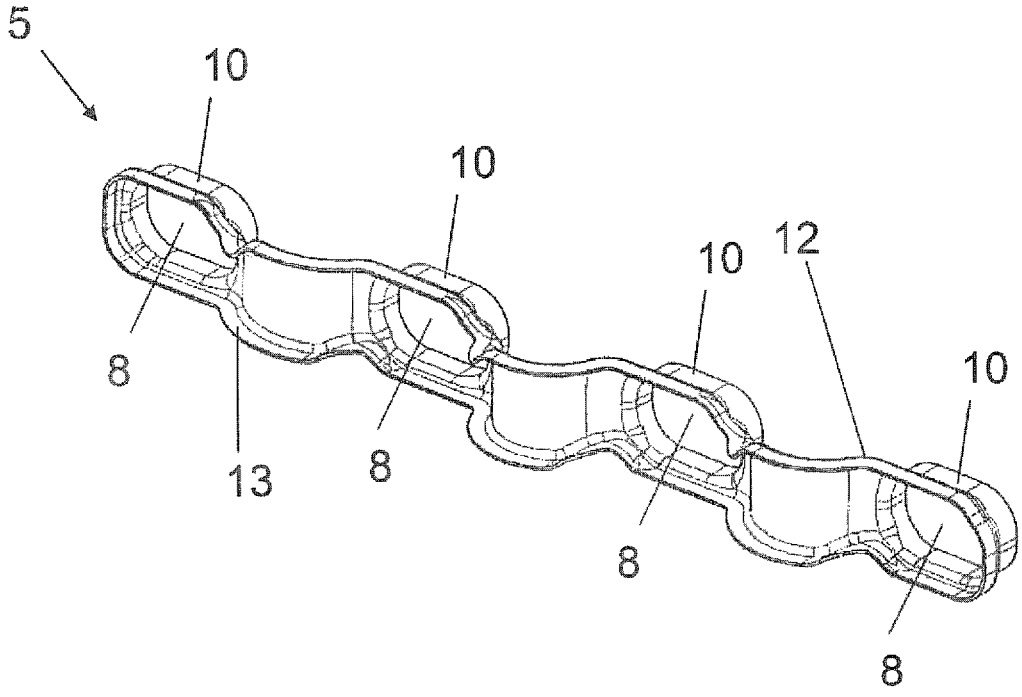
FIG. 3 is a perspective illustration of a baffle plate for use in the exhaust manifold according to the present invention.

FIG. 3 shows that the flanged rim 13 is not only provided in the region curved in an arched manner but also embraces the collars 10. As a result, the baffle plate 5 has increased stiffness also in the area of its openings 8.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. Exhaust manifold, comprising;

a housing formed of a thin-walled sheet metal part shaped in the form of a shell construction and having an upper housing shell and a lower housing shell to define an interior space;

a baffle plate received in the housing in an area proximate to a cylinder head of an internal combustion engine having at least two in-line cylinders and having openings in an area of exhaust ports of the motor flange, said baffle plate separating the interior space of the housing from a motor flange to secure the exhaust manifold to the cylinder head and formed with collars provided in an area of the openings and extending into the exhaust ports; and a sliding fit provided between the collars and the exhaust ports of the motor flange.

2. The exhaust manifold of claim 1, wherein the baffle plate is a single-piece baffle plate.

3. The exhaust manifold of claim 1, wherein the baffle plate is sized to cover surfaces of the motor flange that face the interior space.

4. The exhaust manifold of claim 1, wherein the baffle plate has at least one area which is spaced at a distance from the motor flange in a region between neighboring openings.

5. The exhaust manifold of claim 4, wherein the region between the openings has an arched configuration.

6. The exhaust manifold of claim 1, wherein the baffle plate has a wrap-around contact zone which bears against the upper housing shell and the lower housing shell.

7. The exhaust manifold of claim 6, wherein the contact zone is configured to extend in parallel relation to complementing surfaces of the upper and lower housing shells.

8. The exhaust manifold of claim 6, wherein the contact zone is configured as wrap-around flange arranged on a motor-flange-proximal side of the contact zone.

9. The exhaust manifold of claim 6, wherein the contact zone is configured as wrap-around flange arranged on a motor-flange-distal side of the contact zone.

10. The exhaust manifold of claim 6, further comprising a sealing compound applied to the wrap-around flange.

11. The exhaust manifold of claim 6, wherein the baffle plate is securely fixed to the upper and lower housing shells in at least one area of the contact zone.

12. The exhaust manifold of claim 11, wherein the baffle plate is securely fixed to the upper and lower housing shells by a material joint.

13. The exhaust manifold of claim 11, wherein the material joint includes thermal joining.

* * * * *